United States Patent [19]

Maurhoff et al.

[11] 3,940,927

[45] Mar. 2, 1976

[54] INTERNAL COMBUSTION ENGINE HAVING A REACTOR FOR AFTERBURNING OF UNBURNED EXHAUST GAS CONSTITUENTS

[75] Inventors: Gerhard Maurhoff, Neckarsulm; Johannes Steinwart, Bad Friedrichshall, both of Germany

[73] Assignee: Audi NSU Auto Union Aktiengesellschaft, Neckarsulm, Wurttemberg, Germany

[22] Filed: Aug. 7, 1974

[21] Appl. No.: 495,396

[30] Foreign Application Priority Data

Aug. 9, 1973 Germany ..... 2340342

[52] U.S. Cl. ..... 60/282; 60/322; 60/323

[51] Int. Cl.[2] ..... F01N 3/10; F01N 7/10

[58] Field of Search ..... 60/282, 322, 323

[56] References Cited

UNITED STATES PATENTS

| | | | |
|---|---|---|---|
| 3,177,649 | 4/1965 | Tromel | 60/323 |
| 3,581,494 | 6/1971 | Scheitlin | 60/282 |
| 3,635,031 | 1/1972 | Haddad | 60/282 |
| 3,703,083 | 11/1972 | Tadokoro | 60/322 |

*Primary Examiner*—Douglas Hart
*Attorney, Agent, or Firm*—Kane, Dalsimer, Kane, Sullivan, and Kurucz

[57] ABSTRACT

An internal combustion engine possesses a reactor for afterburning of unburned constituents in the exhaust gas. The reactor includes a shell containing a heat-insulated, freely movable reactor chamber with at least one inlet nozzle extending freely through the shell and communicating with an outlet passage of the combustion engine. An outlet is also provided for escape of the exhaust gases from the reactor chamber.

9 Claims, 3 Drawing Figures

INTERNAL COMBUSTION ENGINE HAVING A REACTOR FOR AFTERBURNING OF UNBURNED EXHAUST GAS CONSTITUENTS

BACKGROUND OF THE INVENTION

In the operation of internal combustion engines the reactor chamber is subjected to substantial temperature fluctuations because of the diverse operating conditions of the engine resulting in considerable thermal distortions of the reactor chamber relative to the outer shell or to the reactor as a whole. The resulting stresses may cause damage to the reactor and adversely affect its performance as well as it service life.

From German publication DT 2,020,154, a reactor is proposed with a chamber arranged freely extensible in the housing shell. The inlet nozzle is attached to the housing of the engine and extends freely through the shell and the wall of the reactor chamber. The inlet nozzle is surrounded by a tubular nozzle attached to the wall of the reactor chamber extending freely through the shell, and sealed to the shell by a diaphragm. This construction is costly and difficult to assemble, and owing to the detachment of the inlet nozzle from the reactor chamber does not allow the latter to be heated up rapidly.

SUMMARY OF THE INVENTION

The object of the invention is to simplify the structure of the reactor, facilitate its attachment to the engine and make it possible to heat up the reactor rapidly.

This object is accomplished, according to the invention by the provisions of an inlet nozzle of the reactor protruding freely into the outlet passage of the engine, and the shell of the reactor having a portion thereof around the inlet nozzle in contact with the housing of the engine while being bolted at its periphery to the engine housing.

In the proposed arrangement, the direct and free protrusion of the inlet nozzle into the outlet passage of the engine serves to achieve rapid heating of the reactor chamber in the desirable manner, since the inlet nozzle is in direct thermally conductive connection with the reactor chamber but not with the engine housing. At the same time, the inlet nozzle is largely free to move in all planes in accordance with the thermal distortions of the reactor chamber, so that no stresses will be set up in the reactor. The attachment of the reactor to the combustion engine by the periphery of the shell results in considerably more convenient accessibility of the bolted connection and in a compact arrangement because of the proximity of the engine.

To achieve a simple and compact design the reactor may advantageously include a shell and the reactor chamber each defined by a substantially cylindrical member composed of two hemicylindrical shells, for example of metal sheet, approximately mirror images of each other. There emanates from the reactor chamber more or less perpendicular to its longitudinal axis an outlet nozzle jacketed in a matching prolongation of the shell. The inlet nozzle extends freely movable through a matching aperture in the shell, and opens into the reaction chamber more or less perpendicular to its longitudinal axis. The halves of the shell and the reactor chamber may be fabricated by simple pressing and stamping means.

The edges of the halves of the shell on the one hand and of the reactor chamber on the other hand are preferably welded together in each instance forming a peripheral flange, with the flange of the reactor chamber being joined to the edges of the half shell, preferably by welding only in the region of the outlet nozzle at a point distant from the chamber wall. The procedure of assembling the reactor entails first placing the reactor chamber welded up at its edge in the halves of the shell. Then to weld the edge of the reactor to the shell is welded only in the region of the outlet nozzle when welding up the edge of the shell. Thus free expansion of the reactor chamber is made possible.

Preferably, the flange of the reactor chamber is guided freely movable between the edges of the halves of the shell outside its area of attachment.

To achieve a vortex motion especially favorable to afterburning of the exhaust gases entering the reactor chamber, the inlet nozzle may open into the reactor chamber tangentially and extend partway into it. This too helps to heat up the wall of the reactor chamber rapidly.

The hemicylindrical half of the shell on the engine side preferably has a greater wall thickness than the other half of the shell, since this part of the reactor, directly in contact with the engine forms the supporting flange of the reactor, because of the bolted connection to the engine.

It is provided further that the inlet nozzle protruding into the outlet passage of the engine with clearance all around, shall be surrounded by a packing to provide a seal between the engine and the reactor. The seal may consist of a steel ring in direct contact with the inlet nozzle and a metal-asbestos ring arranged radially outside it. The steel ring prevents exhaust gas from leaking in between the inlet nozzle and the reactor shell; and the metal-asbestos ring is intended to seal the surface of contact of the reactor with the engine housing.

The packaging may be set in a recess of the housing around the outlet passage of the engine.

DETAILED DESCRIPTION

Figure 1:
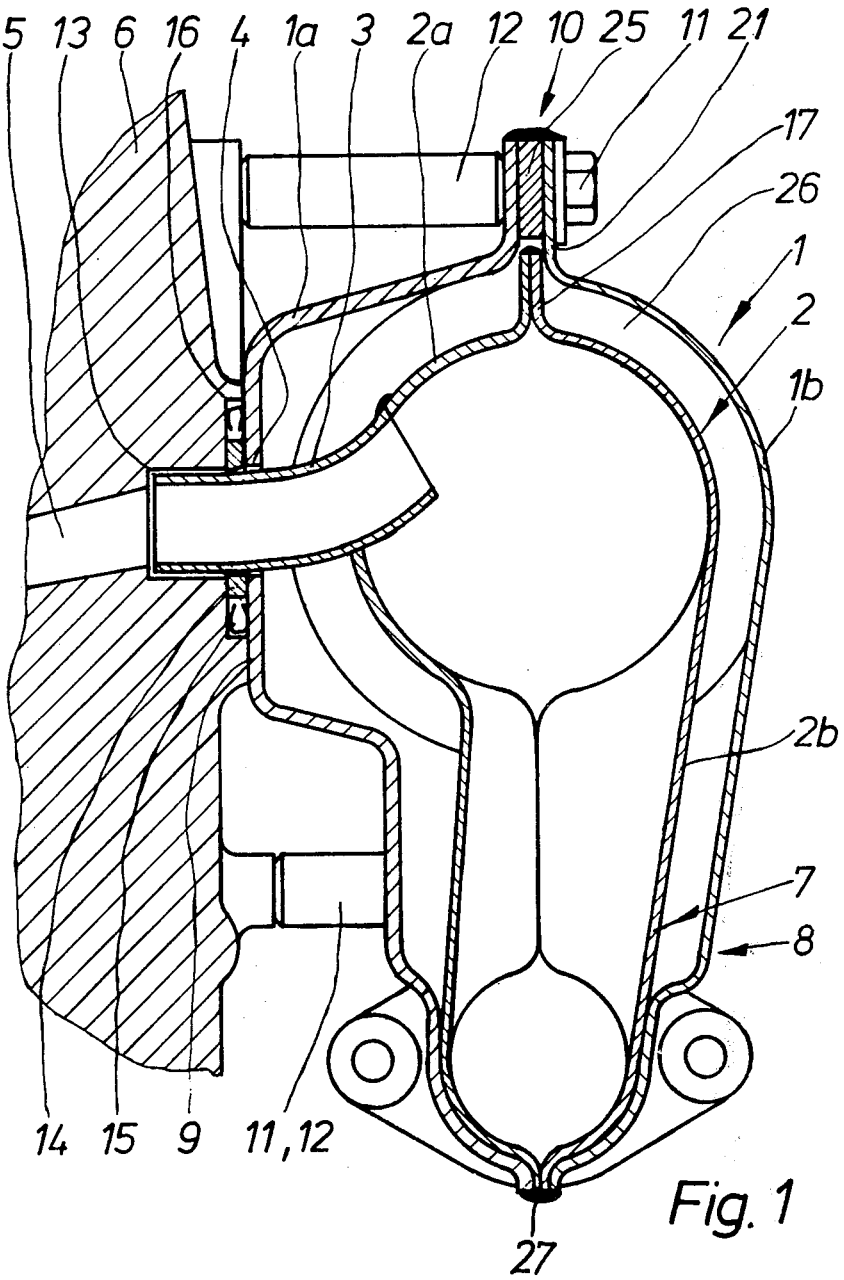
FIG. 1 is a cross-section of a reactor attached to an internal combustion engine having two outlet passages.

The reactor for internal combustion engines of this invention consists of a shell 1 and a heat-insulated reactor chamber 2 arranged freely movable therein, each in the form of a substantially cylindrical member. The shell 1 is composed of two metal sheet halves 1*a* and 1*b* approximately mirror images of each other; and, likewise, the reactor chamber 2 is composed of two metal sheet halves 2*a* and 2*b* approximately mirror images of each other. The reactor chamber 2 possesses two inlet nozzles 3 opening therein tangentially and extending freely movable through apertures 4 in shell 1. Each nozzle communicates with an outlet passage 5 of the engine 6. A tangentially departing outlet nozzle 7 is arranged more or less perpendicular to the longitudinal axis of the reactor chamber 2, and is jacketed in a matching prolongation 8 of the shell 1 and connected to the shell 1 exclusively in this region. The partings of the halves 1*a* and 1*b* and 2*a* and 2*b* preferably lie in one plane.

In the region of each outlet passage 5 a plane contact area 9 of the metal sheet half of shell 1 is in contact with the engine 6, and is bolted to the engine 6 by a peripheral flange 10 parallel to the contact area 9 by means of bolts 11 and spacers 12. Since the metal sheet half 1*a* forms the supporting flange of the reactor, it is thicker than the half 1*b*, in the interests of suitable rigidity of its contact areas 9. Each inlet nozzle 3 protruding into a turned recess 13 in the outlet passage 6 with clearance all around, is encircled by a steel ring 14 in direct contact with the inlet nozzle 3 and an asbestos-filled metal ring 15, both arranged in a recess 16 around the outlet passage 5. The steel ring 14 prevents exhaust gas penetrating the space formed between recess 13 and inlet nozzle 3 from escaping further through the aperture 4 between the shell 1 and the reactor chamber 2 while the metal-asbestos ring 15 seals the contact area 9 from the engine 6. The steel ring 14 fits closely but with lateral play in the recess 16, so that it can follow lateral movements of the inlet nozzle 3 due to thermal deformations of the reactor chamber 2.

Figure 2:
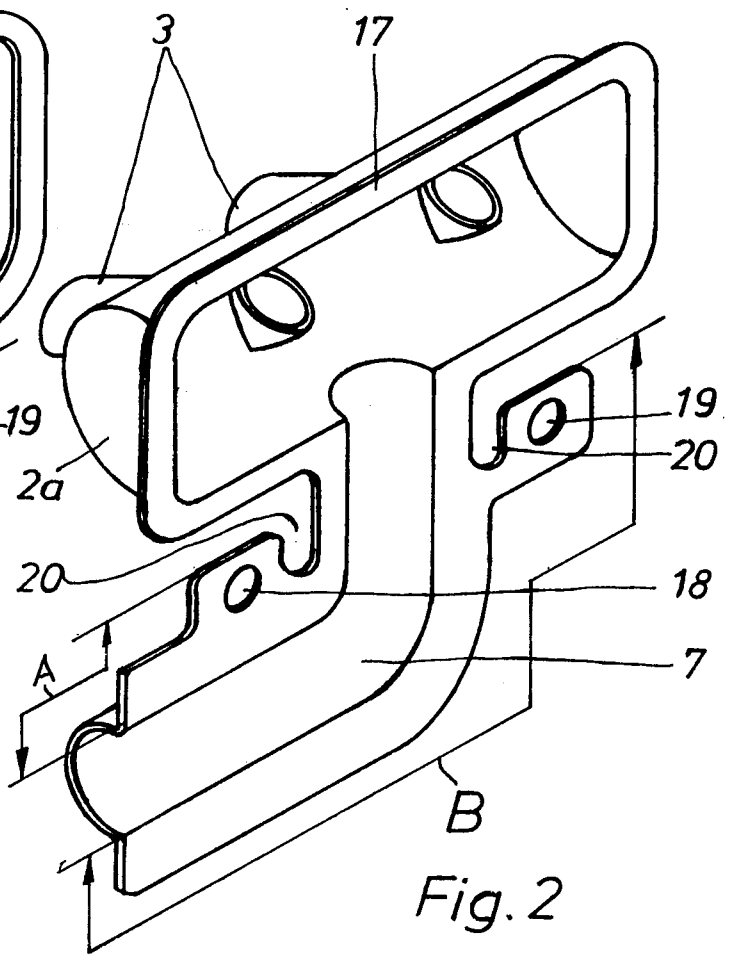
FIG. 2 shows a half of the reactor chamber in perspective.

FIG. 2 represents the metal sheet half 2*a* fabricated by pressing and stamping and having a peripheral edge 17, to be welded to the matching edge of the approximately mirror-image half 2*b* not shown, to form the complete reactor chamber 2. The outlet nozzle 7 is angled at its posterior end and emanates from the center of the reactor chamber 2. The two tangential inlet nozzles 3 viewed in longitudinal direction lie ahead of and behind the outlet nozzle 7, so that the incoming exhaust gases first execute a circling motion along the walls of the reactor chamber 2 before flowing out through the outlet nozzle 7.

Figure 3:
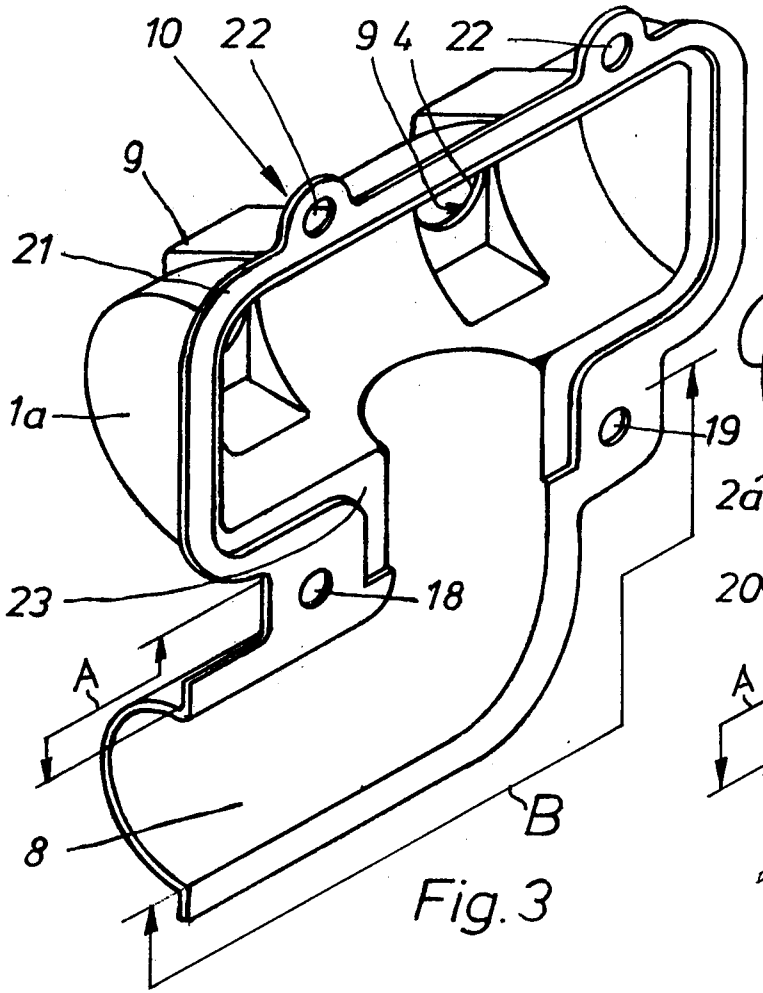
FIG. 3 shows a half of the reactor shell in perspective.

In the region marked A and B, the contour of the reactor chamber 2 is superposable with the contour of the metal sheet half 1*a* or 1*b* shown in FIG. 3 of shell 1 to the inclusion of the holes 18 and 19. Owing to the indentations 20 the outlet nozzle 7 forms a free-standing neck enabling the reactor chamber 2, after being welded up with shell 1 in region A, B to be freely movable within shell 1 outside that region.

The metal sheet half 1*a* of shell 1 as shown in FIG. 3 is likewise fabricated by pressing and stamping and like its more or less mirror image half 1*b* has a peripheral edge 21 which after assembling of the reactor forms a peripheral flange 10 to be bolted to the engine by holes 18, 19 and 22. In the region of the apertures 4, the outer surface of the half shell 1*a* is provided with plane contact areas 9 which, however, may alternatively extend over the entire length of the half shell. The prolongation 8 angled at its lower end emanating from the center of the shell 1 jackets the outlet nozzle 7 of the reactor chamber 2.

To prevent the reactor chamber 2 freely movable within the shell 1 outside the region of its indentations 20, from assuming a change of position beyond the measure of thermal distortions, a guide is provided in the shell 1. The guide consists either of a pressed recess in the halves 1*a* and/or 1*b* more or less parallel to the edge 21, or of a fitted spacer ring 25 (in FIG. 1) placed between the edges 21. In this guide, the edge 17 of the reactor chamber 2 can move freely, the lateral distance being determined by the depth of the recess 23 or a matching thickness of the spacer ring 25. When the half shells 1*a* and 1*b* are welded up along the edge 21 the reactor chamber 2 is connected to the shell 1 at 27 (FIG. 1) in the region A and B of superimposability.

The heat-insulating space 26 between the shell 1 and reactor chamber 2 may contain either circulating air or a filling of insulating material. Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An internal combustion engine having an engine housing and having a reactor for afterburning of unburned constituents in the exhaust gas, the reactor having a shell with a periphery and containing a heat-insulated, reactor chamber connected thereto and being freely movable beyond the point of connection to the shell with at least one inlet nozzle extending freely through the shell and communicating with an outlet passage of the engine, and an outlet for escape of the exhaust gases from the reactor chamber, the inlet nozzle protruding freely into the outlet passage, and the shell having a portion around the inlet nozzle and in contact with the engine housing and being bolted at its periphery to the engine housing, and the inlet nozzle protruding into the outlet passage of the engine with clearance all around and being surrounded by a packing.

2. An engine according to claim 1 in which the shell and the reactor chamber are each defined by a substantially cylindrical member composed of two hemicylindrical edged halves approximately mirror images of each other, an outlet nozzle emanating from the reactor chamber and more or less perpendicular to its longitudinal axis, the outlet nozzle being jacketed in a matching prolongation of the shell, and the inlet nozzle extending freely through a matching aperture in the shell opens into the reactor chamber more or less perpendicular to its longitudinal axis.

3. An engine according to claim 2, in which the engine-side hemicylindrical half of the shell has a greater wall thickness than the other half.

4. An engine according to claim 2, in which the edges of the halves of the shell on the one hand and of the reactor chamber on the other hand are welded together, each forming a peripheral flange, and the flange of the reactor chamber is connected to the edges of the halves of the shell only in the region of the outlet nozzle in a region distant from the chamber wall.

5. An engine according to claim 4, in which the flange of the reactor chamber is guided freely movable between the edges of the halves of the shell outside its area of attachment to the shell.

6. An engine according to claim 1, in which the inlet nozzle opens into the reactor chamber tangentially and extends partway into it.

7. An engine according to claim 1, characterized in that the packing is comprised of a steel ring in direct contact with the inlet nozzle and a metal-asbestos ring arranged radially outside it.

8. An engine according to claim 1, in which the packing is set in a recess in the housing around the outlet passage.

9. An internal combustion engine having an engine housing and having a reactor for afterburning of unburned constituents in the exhaust gas, the reactor having a shell with a periphery and containing a heat-insulated reactor chamber connected thereto and being freely movable beyond the point of connection to the shell with at least one inlet nozzle extending freely through the shell and communicating with an outlet passage of the engine in position to permit the inlet nozzle to be heated very quickly by exhaust gases, and an outlet for escape of the exhaust gases from the reactor chamber, the inlet nozzle protruding freely into the outlet passage, and the shell having a portion around the inlet nozzle and in contact with the engine housing and being bolted at its periphery to the engine housing, and the inlet nozzle protruding into the outlet passage of the engine with clearance all around and being surrounded by a packing.

* * * * *